US005897423A

United States Patent [19]

Rosenberg

[11] Patent Number: 5,897,423

[45] Date of Patent: Apr. 27, 1999

[54] POST-PREGNANCY COMPRESSION GARMENT

[76] Inventor: Jennifer Rosenberg, 724 Glouchester St., Boca Raton, Fla. 33487

[21] Appl. No.: 08/818,351

[22] Filed: Mar. 17, 1997

[51] Int. Cl.[6] ..... A41C 1/00; A41C 1/12

[52] U.S. Cl. ..... 450/115; 450/120; 450/122; 450/124; 450/126; 450/130; 450/135; 450/136; 450/137

[58] Field of Search ..... 450/114, 115, 450/116, 117, 122, 124, 136, 137, 138, 102, 103, 104, 105, 140, 118, 119, 123, 120, 121, 125, 126, 127, 128, 129, 130, 131, 132, 134, 135, 155, 156; 2/273, 406, 400, 401, 402, 408

[56] References Cited

U.S. PATENT DOCUMENTS

| | | | |
|---|---|---|---|
| 1,934,862 | 11/1933 | Kops . | |
| 1,996,626 | 4/1935 | Robinson | 450/138 |
| 2,016,355 | 10/1935 | Alsop | 2/406 X |
| 2,393,612 | 1/1946 | Bullenger | 450/114 |
| 2,596,155 | 5/1952 | Kleinman | 450/137 |
| 2,655,658 | 10/1953 | Connors | 450/116 |
| 2,705,324 | 4/1955 | Kleinman | 450/136 |
| 2,949,917 | 8/1960 | Arcuri | 450/117 |
| 3,338,245 | 8/1967 | Laguzzi | 450/124 X |
| 3,339,554 | 9/1967 | Nobbs | 450/124 X |
| 3,431,913 | 3/1969 | Bugnon et al. | 450/122 |
| 3,621,849 | 11/1971 | Williams . | |
| 3,734,101 | 5/1973 | Lo Cascio . | |
| 3,752,164 | 8/1973 | Zalisky . | |
| 4,746,318 | 5/1988 | Moyer . | |
| 4,976,653 | 12/1990 | White . | |

*Primary Examiner*—Jeanette Chapman
*Attorney, Agent, or Firm*—McHale & Slavin, PA

[57] ABSTRACT

A post-pregnancy compression garment that provides abdominal support to facilitate a faster return to the individual's pre-pregnancy figure. The garment consists of a tubular body encompassing an anatomical region from the thighs to beneath the chest. Compression material or strips are constructed from an elastic memory fabric positioned so as to cause compression to the abdomen area. Maximum compression may be provided to the waist section with the remaining portion of the garment providing support with minimum compression.

7 Claims, 3 Drawing Sheets

POST-PREGNANCY COMPRESSION GARMENT

FIELD OF THE INVENTION

This invention relates to post-pregnancy rehabilitation and, in particular, to a garment worn by a woman after childbirth which creates a compression to the skin and underlying tissues/muscles to encourage shrinkage of the abdomen to pre-pregnancy conditions.

BACKGROUND OF THE INVENTION

The period following a pregnancy can be traumatic for a woman who is unaccustomed to the demands placed upon her body. In particular, the carrying of a child through term requires the woman's abdomen to be enlarged for proper development of the child. Upon birth and removal of the placenta, the body temporarily remains in an enlarged state wherein shrinkage of the abdomen takes a period of time before returning to the prepregnancy state. The problem, to which this invention is directed, is the amount of time it takes in order for the abdomen to return to the pre-pregnancy state. After childbirth, the woman's lower abdomen tends to sag in unsightly folds. The instant invention allows for a specially designed compression garment that within weeks to months of wearing will result in the reduction of the mass of loose skin/tissue/muscle and facilitate a faster return to the individual's pre-pregnancy figure.

There are a number of products used to support a woman's abdominal area during pregnancy. These devices are for the benefit of improved appearance or support of the unborn. For instance, U.S. Pat. No. 4,746,318 discloses a maternity exercise garment that provides support during exercise. The garment is close fitting without placing excess pressure on the abdomen.

U.S. Pat. No. 4,976,653 discloses a maternity garment having a two position band that provides a range of support to the woman. This support is directed between two positions for lessening the stress on the woman's abdominal muscles. However, such a garment cannot be worn continuously due to the uncomfortable state in which it places the woman's body.

Compression garments have been used post-operative following various surgeries with results shown to dramatically reduce edema, shorten recovery, skin shrinkage and achieve the positive reduction results much earlier than had no compression device been employed. Sequential compression devices are marketed for the prevention of deep venous thrombosis and embolism in trauma patients or major surgical patients. However, many thrombosis devices that provide compression are only adequate to help prevent deep venous thrombosis and are used solely for compression of the lower leg.

Compression garments are also commonly used after liposuction. The compression garment facilitates drainage of anesthetic solution and prevent accumulation of fluid within the tunnels in the subcutaneous fat created by the suction cannula. With some liposuction techniques there is also a considerable amount of bleeding and residual blood remaining in the tunnels after surgery. In this manner, the compression garments worn for a number of weeks helps restore the body to the original condition. In addition, the compression garments hold the bulky absorbent dressings in place, all of which help minimize the discomfort associated with the copious drainage after surgery.

Known compression garments consist of a fiber count fabric composition that provides support and elasticity. For instance, a number of compression garments are constructed from 80% nylon and 20% elastic memory fabric, such as that available under the trademark SPANDEX. The weave of the garment fabric facilitates dissipation of body heat and transfer of moisture away from the body. However, the garments typically only work as compression garments without providing directional stability.

Known compression garments that provide directional stability are typically designed to shape the body. For instance, U.S. Pat. No. 3,752,164 issued to the Playtex Corporation discloses a compression garment providing multiple region abdominal control. This garment forms a girdle with vertically distensible spaced apart lines of "zigzag stitching" which helps resist horizontal stresses.

U.S. Pat. No. 3,621,849 discloses a therapeutic garment for maternity use which is intended to be adapted to be worn by pregnant women for providing shapely abdominal support. This garment is directed to the pregnancy stage and does not provide for post-pregnancy support.

Thus, what is lacking in the art is a compression garment for use in post-pregnancy, having a shape that facilitates the shrinkage of the body area most affected by the pregnancy process.

SUMMARY OF THE INVENTION

The instant invention allows for a specially designed compression garment that, typically within weeks to months of wearing, will result in the reduction of the mass of loose skin/tissue/muscle and facilitate a faster return to the individual's pre-pregnancy figure. The compression garment is designed to keep the loose skin/tissue/muscle firmly pressed against the lower abdomen.

The garment consists of a tubular body encompassing an anatomical region defined as high cut around the thighs to beneath the chest. The tubular body is constructed from a material, such as knitted fabric, which allows a sufficient amount of stretch so as to allow the woman to comfortably install the garment but not place excess pressure on the woman once installed. The garment may include a panel fastener so as to assist in installation. In one embodiment, a plurality of compression strips constructed from an elastic memory fabric, such as that available under the trademark SPANDEX, are placed across the abdomen in a manner so as to cause directional compression to the waist section with the remaining portion of the garment providing only support to the compression strips. The result is minimum compression extended to the remainder of the garment with maximum compression to the waist area and lower abdomen.

The size of the garment is dependant upon the size of the woman, however, the compression strips may also be made adjustable allowing for larger range of compression. It is noted that a predetermined amount of compression is the preferred embodiment. In this manner the maximum compression is provided when first worn, which is directly after childbirth, providing maximum compression. As the stomach rescinds, the compression is maintained but at a reduced level.

An alternative embodiment teaches the use of adjustments that are positioned on the side of the garment. This embodiment allows the garment to be adjusted to meet the particular stage of a woman's figure during post-pregnancy rehabilitation. The garment may include the use of adjustment straps or zippers located on each side of the garment. The adjustment allows various degrees of compression allowing the woman to compensate for the reduction of in size by simply moving the adjustment to the desired degree of compression.

Still another embodiment is to disclose the use of a single compression material that is not enhanced in any particular area. This can be accomplished by the use of a compression material, such as that available under the trademark POWERNET, that when placed into the garment proposed by this invention, provides a uniform compression in the abdomen area.

Thus, an object of the invention is to disclose a compression garment for use in the support and reduction of the mass of loose skin/tissue/muscle post-pregnancy.

Another object of the invention is to disclose a compression garment for use in the proper positioning of the loose skin/tissue/muscle of a woman for correctly compressing the skin against the lower abdomen for purposes of reduction.

Still another object of the invention is to teach the use of a support to provide compression directly to the abdomen with minimum compression or discomfort to the surrounding areas.

Yet still another object of the invention is to teach the use of a support having adjustable compression strips to vary the amount of compression placed on the abdomen.

Yet another object of the invention is to teach the use of a garment that is breathable and allows for stretching to provide a comfortable garment during installation and while providing for skin and muscle shrinkage.

Another object of the invention is to teach the use of adjustment straps that allow for adjusting the level of compression with the need for changing of a garment.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENT

Figure 1:
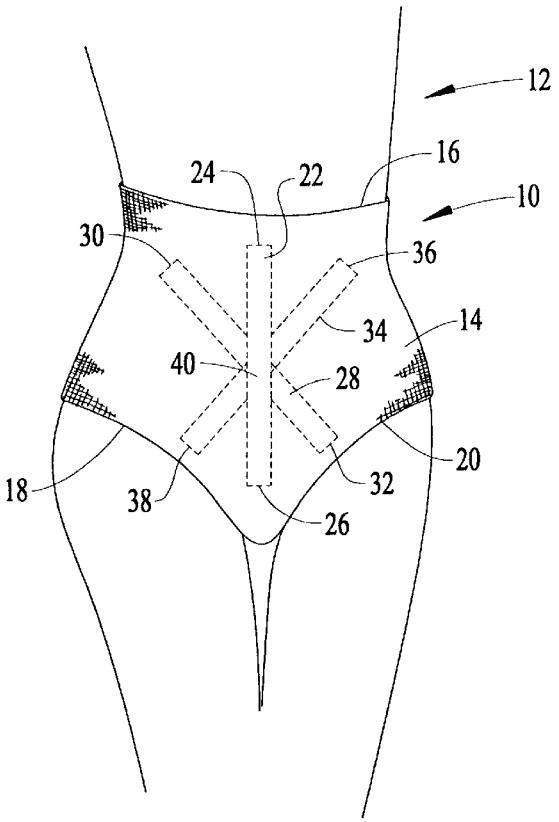
FIG. 1 is a frontal view of a preferred embodiment of the garment of the present invention, schematically depicted as being worn by a wearer.

In accordance with the aspects of the present invention, FIG. 1 depicts the garment 10 as worn by the wearer 12 having a front side 14 and a back side, not shown. The garment 10 is adapted to fit the wearer's body having a tubular shape with a torso opening 16 and first and second leg openings 18, 20. The garment is constructed of an elastic material, such that available under the trademark Spandex, to provide a form fitting shape. The front side 16 includes an area of high elasticity designed to provide the maximum compression to the lower abdomen. The elastic bands may include a longitudinal strip 22 providing compression between upper end 24 and lower end 26, cross strip 28 providing compression between upper end 30 and lower end 32; and cross strip 34 providing compression between upper end 36 and lower end 38.

In this embodiment, the bulk of the compression is directed to the central area 40 wherein the three strips converge, providing a uniform compression in multiple directions. The central area 40 tends to pull the lower abdomen up and back. To avoid adding bulk to the front side, the strips need not overlap in the central area and simply meet at this section to provide maximum centralized compression. If worn regularly, the compression garment will result in the reduction of the mass of loose skin/tissue/muscle and facilitate a faster return to the individual's pre-pregnancy figure. The compression garment is designed to keep the loose skin/tissue/muscle firmly pressed against the lower abdomen.

The straps 22, 28 and 34 may also be made adjustable to provide a range of compression to the central area 40 with minimum compression or discomfort to the wearer. The compression being directed to the central portion 40 with the remaining garment area providing support for the compression strips thereby distributing the compression support throughout the rear side resulting in minimum compression areas. The invention allows the garment to include various options such as removable panty bottoms, crotch release/attachment, and overall size adjustment in addition to the compression adjustment. The size of the garment is dependant upon the size of the woman, however, the compression strips may also be made adjustable allowing for larger range of compression.

It is noted that a predetermined amount of compression is the preferred embodiment. In this manner the maximum compression is provided when first worn, which is directly after childbirth, providing maximum compression. As the stomach rescinds, the compression is maintained but at a reduced level.

Figure 2:
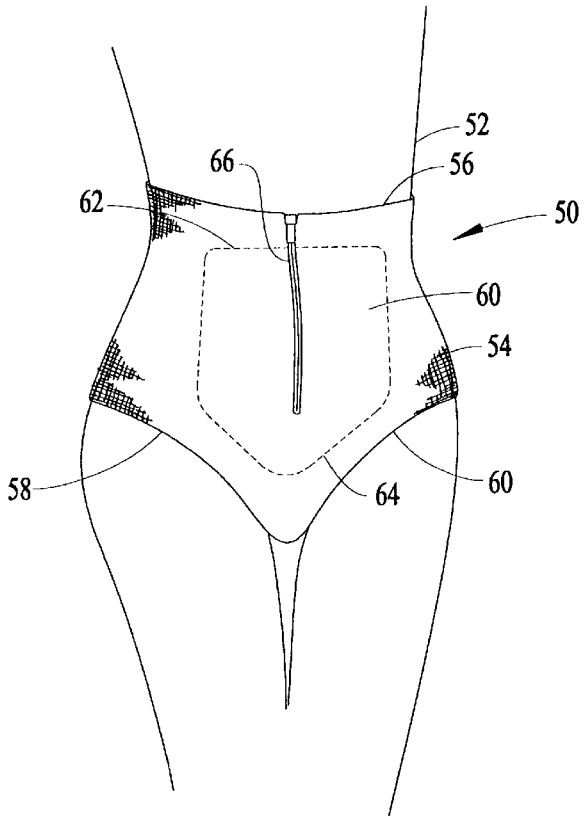
FIG. 2 is a frontal view of an alternative embodiment employing a frontal opening of the present invention.

FIG. 2 depicts yet another embodiment of the present invention with garment 50 as worn by the wearer 52 having a front side 54 and a back side, not shown. The garment 50 is adapted to fit the wearer's body having a tubular shape with a torso opening 56 and first and second leg openings 58, 60. The garment is constructed of elastic nylon/LYCRA spandex providing a form fitting shape. The front side 56 includes an area 60 of high elasticity designed to provide the maximum compression to the lower abdomen. The area 60 is of an elasticity higher than the remaining garment providing an increased area of compression between upper end 62 and lower end 64. In this manner, the bulk of the compression remains directed to the central area 60 provides uniform compression in multiple directions yet tends to pull the lower abdomen up and back.

If worn regularly, the compression garment will result in the reduction of the mass of loose skin/tissue/muscle and facilitate a faster return to the individual's pre-pregnancy figure. The compression garment is designed to keep the loose skin/tissue/muscle firmly pressed against the lower abdomen.

The garment may also be made adjustable to provide a range of compression to the central area 60 with minimum compression or discomfort to the wearer. The invention allows the garment to include various options such as frontal garment attachment by use of a zipper 66, removable panty bottoms, crotch release/attachment, and overall size adjustment in addition to the compression adjustment. The size of the garment is dependant upon the size of the woman, however, the compression area may also be made adjustable allowing for larger range of compression.

It is noted that a predetermined amount of compression is the preferred embodiment. In this manner the maximum compression is provided when first worn, which is directly after childbirth, providing maximum compression. As the stomach rescinds, the compression is maintained but at a reduced level.

Figure 3:
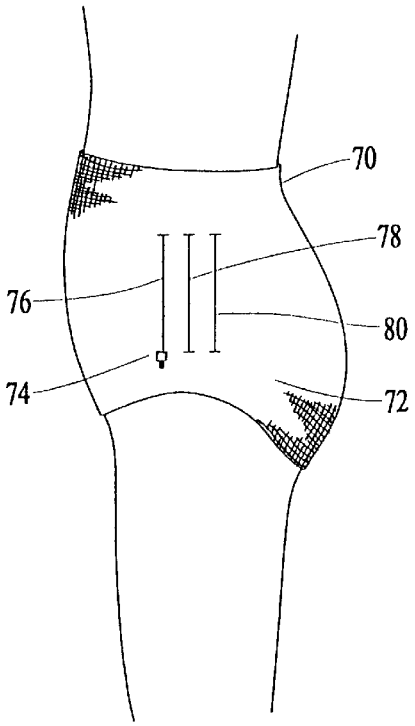
FIG. 3 is a side view of an alternative embodiment employing a side adjustment of the present invention.

Now referring to FIG. 3, in order to increase, reduce or maintain compression on the abdomen throughout the rehabilitation process, the garment 70 may contains a zipper attachment 72 placed along one or both sides of the garment for tightening or loosening the garment for the specific area of the body. As the abdomen returns to its pre-pregnancy normal size, the zippers can be adjusted by zipping the zipper to a certain degree to maintain tension of the body within the garment. The zipper or zipper attachments can be zipped to any certain point along the zipper area and held in that position by pressing the zipper flap down into a secure position, until the person desires to either tighten or loosen the area by again zipping up or down the zipper to a position that is desired by the person wearing the garment. For instance, the garment 70 depicted includes a zipper handle 74 which is secured to vertical zipper line 76. When left unattached, the zipper attachment 72 provides minimum compression.

When zipper handle 74 is attached to second vertical zipper line 78, the spacial distance between zipper line 76 and 78 is removed providing increased compression. When zipper handle 74 is attached to third vertical zipper line 80, the spacial distance between zipper line 76 and 80 is removed providing maximum compression. This compression adjustment further allows the individual more comfort during the positioning process. The garment may consist of another similar devices for adjusting the size including snaps, hook and eye closures, hook and loop fastening material or the like.

Figure 4:
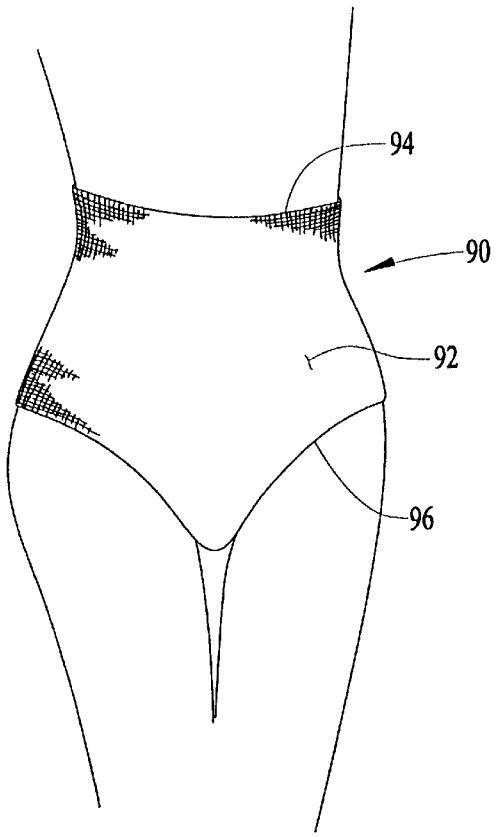
FIG. 4 is a frontal view of an alternative embodiment employing a single compression material of the present invention.

FIG. 4 depicts the garment 90 formed from a straight compression material 92 such as that manufactured by Elastic Fabric of America and sold under the trademark POWERNET. The straight compression material may include a form fit that lessens the amount of compression along the upper edge 94 and the leg opening 96.

Figure 5:
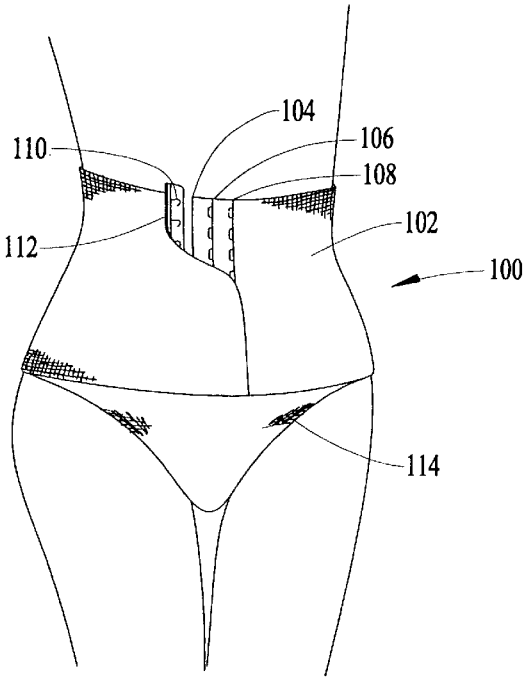
FIG. 5 is a frontal view of an alternative embodiment employing snaps for frontal adjustment of the present invention.
Figure 6:
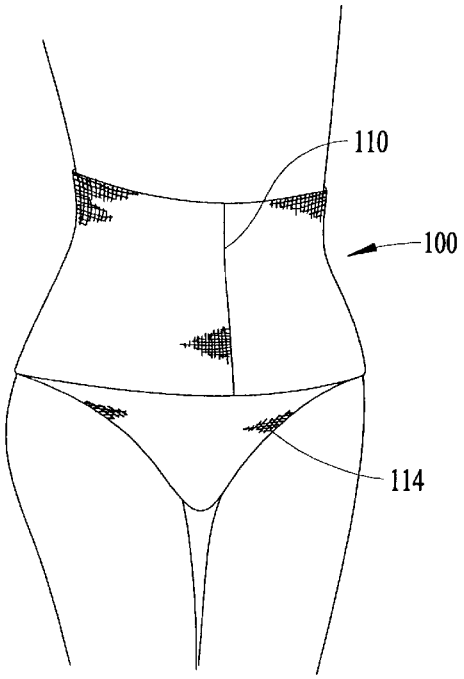
FIG. 6 depicts FIG. 5 in a closed position.
Figure 7:
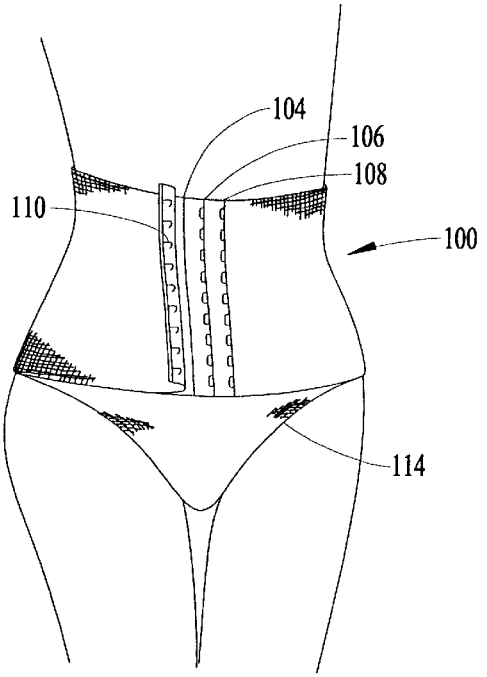
FIG. 7 depicts FIG. 5 in an open position.

Now referring in general to FIGS. 5–7, set forth is yet another embodiment of the instant invention depicting a one-piece garment 100 having an upper layer of compression 102 formed by a singular wrap of compression material having a first end 104 with a plurality of vertically disposed eyes 106 placed adjacent to the first end 104. A second row of eyes 108 is placed adjacent to the first row 106 and is available for coupling to the hooks 110 placed adjacent to a second end 112 of the upper layer of compression. The hooks 110 are secured to eyes 106 or 108 for adjusting the amount of compression around the abdomen. Free end 104 inhibits the hooks from contacting the skin allowing for comfort while end 112 conceals the eye hook attachment means when in a closed position. The opening further permits ease of installing the garment and an attachment panty 114 provides minimal, if any compression.

FIG. 6 depicts the garment 100 in closed position with end 110 concealing the eye hook attachment means. FIG. 7 depicts the garment 100 in an open position illustrating the line of eyes 106 placed adjacent to the end 104 and a second line of eyes 108 placed adjacent to the first set allowing manual adjustment of hooks 110 in relation to the amount of compression desired or required.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A post-pregnancy compression garment comprising:

a support structure sized to conform to the anatomical shape of a woman between the hips and the chest;

compression means positioned along a frontal portion of said structure, said compression means being defined as a plurality of elastic strips positioned so as to cause a direct compression to the abdominal region of a woman when said garment is worn;

said compression garment further including a means for adjusting said strips to provide a variance in the amount of said direct compression provided by the garment;

wherein said support structure is worn by a woman after pregnancy whereby said compression means provides a directional support to the abdominal region to facilitate a faster return to the individual's pre-pregnancy figure.

2. The post-pregnancy compression garment according to claim 1 wherein said elastic strips are elongated and placed in a criss-cross manner providing the highest compression at the point of crossing.

3. The post-pregnancy compression garment according to claim 1 wherein said support structure is sized to extend above the hips of a woman.

4. The post-pregnancy compression garment according to claim 1 wherein said support structure includes removable panty liner.

5. The post-pregnancy compression garment according to claim 1 wherein said support structure is breathable.

6. The post-pregnancy compression garment according to claim 1 wherein said support structure is stretchable.

7. The post-pregnancy compression garment according to claim 1 wherein said means for adjusting said strips includes:

a first zipper line;

a plurality of second zipper lines oriented parallel to said first zipper line; and a zipper handle for selectively joining said first zipper line to one of said second zipper lines.

* * * * *